US011749943B2

(12) United States Patent
Kondo

(10) Patent No.: US 11,749,943 B2
(45) Date of Patent: Sep. 5, 2023

(54) CONNECTOR MATING BODY

(71) Applicant: SUMITOMO WIRING SYSTEMS, LTD., Mie (JP)

(72) Inventor: Tomoyuki Kondo, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 270 days.

(21) Appl. No.: 17/413,234

(22) PCT Filed: Dec. 5, 2019

(86) PCT No.: PCT/JP2019/047615
§ 371 (c)(1),
(2) Date: Jun. 11, 2021

(87) PCT Pub. No.: WO2020/129677
PCT Pub. Date: Jun. 25, 2020

(65) Prior Publication Data

US 2022/0077629 A1 Mar. 10, 2022

(30) Foreign Application Priority Data

Dec. 17, 2018 (JP) ..... 2018-235048

(51) Int. Cl.
*H01R 13/627* (2006.01)
*H01R 13/621* (2006.01)
(Continued)

(52) U.S. Cl.
CPC ..... *H01R 13/6215* (2013.01); *H01R 13/426* (2013.01); *H01R 13/5202* (2013.01)

(58) Field of Classification Search
CPC ..... H01R 13/6215; H01R 13/426; H01R 13/5202
(Continued)

(56) References Cited

U.S. PATENT DOCUMENTS 3,636,502 A * 1/1972 Wallace ..... H01R 4/32 439/626
4,483,575 A * 11/1984 Kruger ..... H01R 13/6215 439/367
(Continued)

FOREIGN PATENT DOCUMENTS

JP 2009-097526 A 5/2009
JP 2013-122900 A 6/2013
JP 2013-143241 A 7/2013

OTHER PUBLICATIONS

International Search Report dated Feb. 18, 2020 for WO 2020/129677 A1 (4 pages).

*Primary Examiner* — Abdullah A Riyami
*Assistant Examiner* — Vladimir Imas
(74) *Attorney, Agent, or Firm* — Venjuris, P.C.

(57) ABSTRACT

It is aimed to provide a connector mating body capable of preventing a sealing member from damage when a bolt is tightened and loosened. A connector mating body (1) is formed by tightening a bolt (4) arranged in a collar (6) of a first housing (2) with a nut (5) of a second housing (3). A reduced-diameter portion (44) having a smaller outer diameter than a flange portion (43) of a head portion (41) is formed on a part of a tip side (L2) of the head portion (41) of the bolt (4). A tip surface (441) of the reduced-diameter portion (44) is in contact with a base end surface (611) of the collar (6). A tip part (462) of a first oil-proof sealing member (46) is sandwiched between the base end surface (611) of the collar (6) and a tip surface (431) of the flange portion (43).

7 Claims, 10 Drawing Sheets

(51) Int. Cl.
*H01R 13/426* (2006.01)
*H01R 13/52* (2006.01)

(58) Field of Classification Search
USPC ..... 439/359
See application file for complete search history.

(56) References Cited

U.S. PATENT DOCUMENTS

| | | | | | |
|---|---|---|---|---|---|
| 5,266,047 | A * | 11/1993 | Black | H01R 13/6215 | 439/364 |
| 5,295,856 | A * | 3/1994 | Endo | H01R 13/6215 | 439/924.1 |
| 5,820,401 | A * | 10/1998 | Hasz | H01R 13/5221 | 439/364 |
| 5,971,791 | A * | 10/1999 | Itoh | H01R 13/5213 | 439/364 |
| 8,348,689 | B2 * | 1/2013 | Shibata | H01R 13/6215 | 439/271 |
| 8,465,313 | B2 * | 6/2013 | Shibata | H01R 13/5202 | 439/271 |
| 8,622,674 | B2 * | 1/2014 | Shibata | H01R 13/5202 | 411/105 |
| 9,048,572 | B2 * | 6/2015 | Shibata | H01R 13/6215 | |
| 10,594,072 | B2 * | 3/2020 | Lim | H01R 13/6215 | |
| 10,739,833 | B2 * | 8/2020 | Chai | G06F 1/203 | |
| 11,381,034 | B2 * | 7/2022 | Kondo | H01R 13/5202 | |

* cited by examiner

CONNECTOR MATING BODY

CROSS REFERENCE TO RELATED APPLICATIONS

This application is a national phase of PCT application No. PCT/JP2019/047615, filed on 5 Dec. 2019, which claims priority from Japanese patent application No. 2018-235048, filed on 17 Dec. 2018, all of which are incorporated herein by reference.

TECHNICAL FIELD

The present disclosure relates a connector mating body in which a first housing and a second housing holding terminals are mated using a bolt.

BACKGROUND

In connecting various electronic control devices to a controller, a relay connector for relaying electrical wiring leading to the electronic control devices and the controller is used. The relay connector is used as a connector mating body in which a male connector including a plurality of male terminals and a female connector including a plurality of female terminals, to which the plurality of male terminals are respectively conductively connected, are mated. Besides a structure to be directly mated by a worker, a lever-type mating structure utilizing the principle of leverage, a tightening-type mating structure utilizing a tightening force of a bolt and the like have been proposed as a mating structure of a male connector and a female connector to facilitate mating by a worker.

A connector disclosed, for example, in Patent Document 1 is known as a connector mating body having a tightening-type mating structure. In Patent Document 1, a bolt inserted through a through hole of a hollow cylindrical mounting portion of a first housing is tightened with a nut provided in a second housing, whereby the first and second housings are mated.

PRIOR ART DOCUMENT

Patent Document

Patent Document 1: JP 2013-122900 A

SUMMARY OF THE INVENTION

Problems to be Solved

In the connector of Patent Document 1, the bolt and the nut are made of metal, whereas the first and second housings are made of resin in most cases. A head portion of the bolt and the nut directly face each other and a mated state of the first and second housings is maintained by coupling metal members, i.e. the bolt and the nut.

Further, a sealing member for sealing a clearance between the head portion and the first housing to prevent the entrance of water, oil and the like into the clearance is arranged on the outer periphery of the head portion of the bolt. However, if the sealing member is arranged on the outer periphery of the head portion of the bolt, the sealing member slides on the inner peripheral surface of the through hole of the first housing when the bolt is tightened with the nut. Thus, there remains room for improvement to protect the sealing member from damage when the bolt is repeatedly tightened and loosened.

The present disclosure was developed in view of such a problem and aims to provide a connector mating body capable of preventing a sealing member from damage when a bolt is tightened and loosened.

Means to Solve the Problem

One aspect of the present disclosure is directed to a connector mating body with a first housing holding a plurality of first terminals, a second housing holding a plurality of second terminals to be respectively conductively connected to the first terminals, the second housing being mated with the first housing, a collar made of metal and arranged in a first insertion hole of the first housing, a nut made of metal and arranged in a second insertion hole of the second housing, and a bolt made of metal and including a head portion configured to come into contact with a base end surface of the collar and a shaft portion coaxially connected to a tip side of the head portion, having a smaller outer diameter than the head portion, partially arranged on an inner peripheral side of the collar and formed with an external thread to be threadably engaged with an internal thread of the nut, wherein a reduced-diameter portion having a smaller outer diameter than a maximum outer diameter portion of the head portion is formed on a tip side part of the head portion, a tip surface of the reduced-diameter portion is in contact with a base end surface of the collar, and a sealing member is sandwiched between the base end surface of the collar and a tip surface of the maximum outer diameter portion adjacent to the reduced-diameter portion.

Effect of the Invention

In the connector mating body of the above aspect, the first and second housings are prevented from being compressed more than necessary by sandwiching the collar made of metal between the head portion of the bolt and the nut. Further, the sealing member can be protected from damage by devising the shape of the head portion of the bolt and the arrangement position of the sealing member.

Specifically, the collar sandwiched between the head portion of the bolt and the nut is arranged on the outer periphery of the shaft portion of the bolt, and the reduced-diameter portion is formed on the outer periphery of the head portion of the bolt. The sealing member is sandwiched between the base end surface of the collar and the tip surface of the maximum outer diameter portion adjacent to the reduced-diameter portion. In this way, the sealing member is not arranged on the outer peripheral surface of the shaft portion in the bolt to be arranged in the collar, and the sealing member does not slide on the inner peripheral surface of the collar when the bolt is tightened or loosened. Thus, the sealing member can be prevented from damage when the bolt is tightened and loosened.

When the tip surface of the reduced-diameter portion of the bolt comes into contact with the base end surface of the collar and the sealing member is sandwiched between the tip surface of the maximum outer diameter portion of the head portion in the bolt and the base end surface of the collar, the clearance between the bolt and the collar can be sealed by the sealing member. Further, when the bolt is tightened with the nut, a positional relationship of the first and second housings is fixed by coupling metal members, i.e. the bolt, the collar and the nut, to each other. Thus, the first and second housings are not compressed more than necessary and a mated state of the first and second housings is properly maintained.

Therefore, according to the connector mating body of this embodiment, the sealing member can be prevented from damage when the bolt is tightened and loosened.

DETAILED DESCRIPTION TO EXECUTE THE INVENTION

First Embodiment

Figure 1:
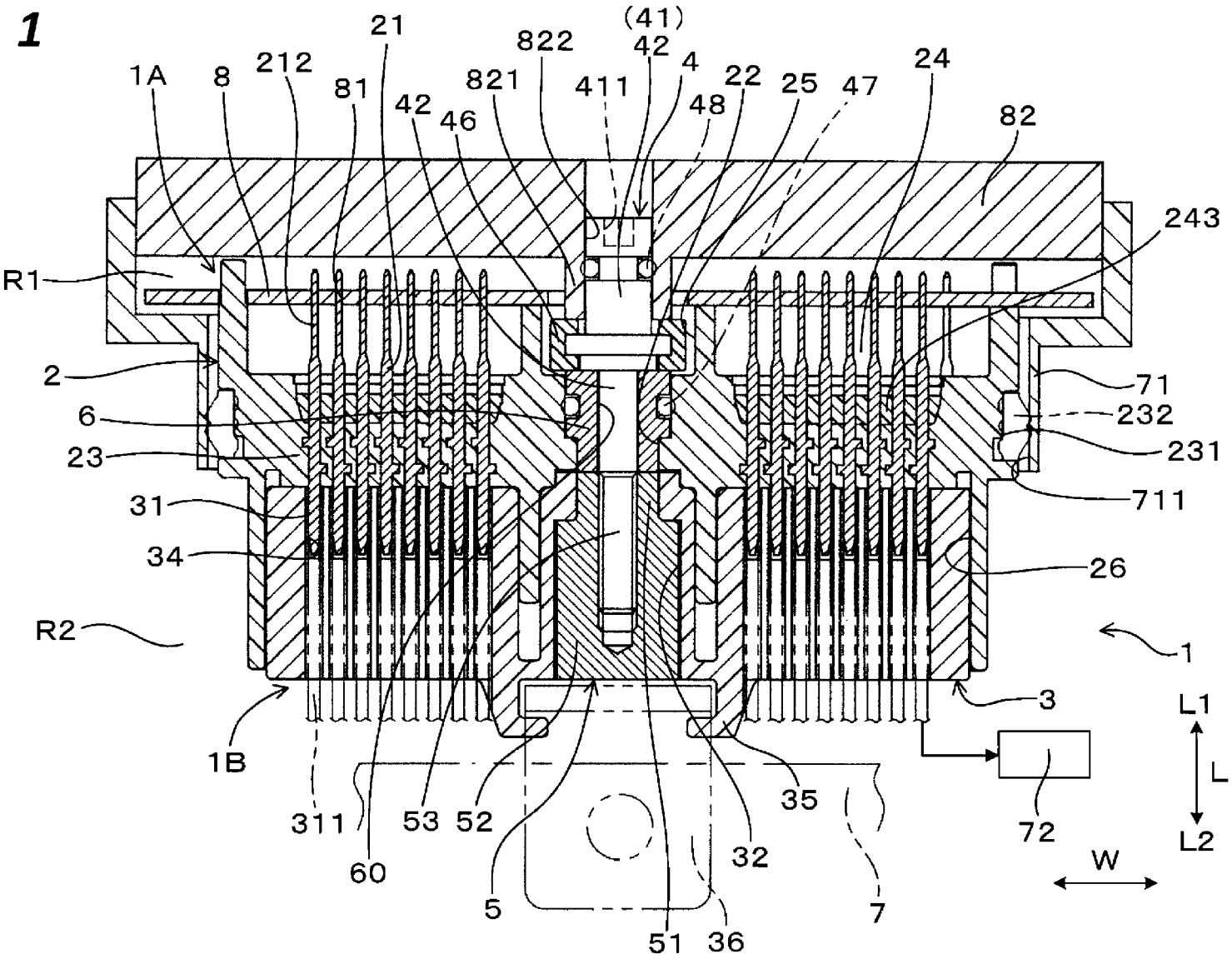
FIG. 1 is a front view in section of a connector mating body according to a first embodiment.
Figure 2:
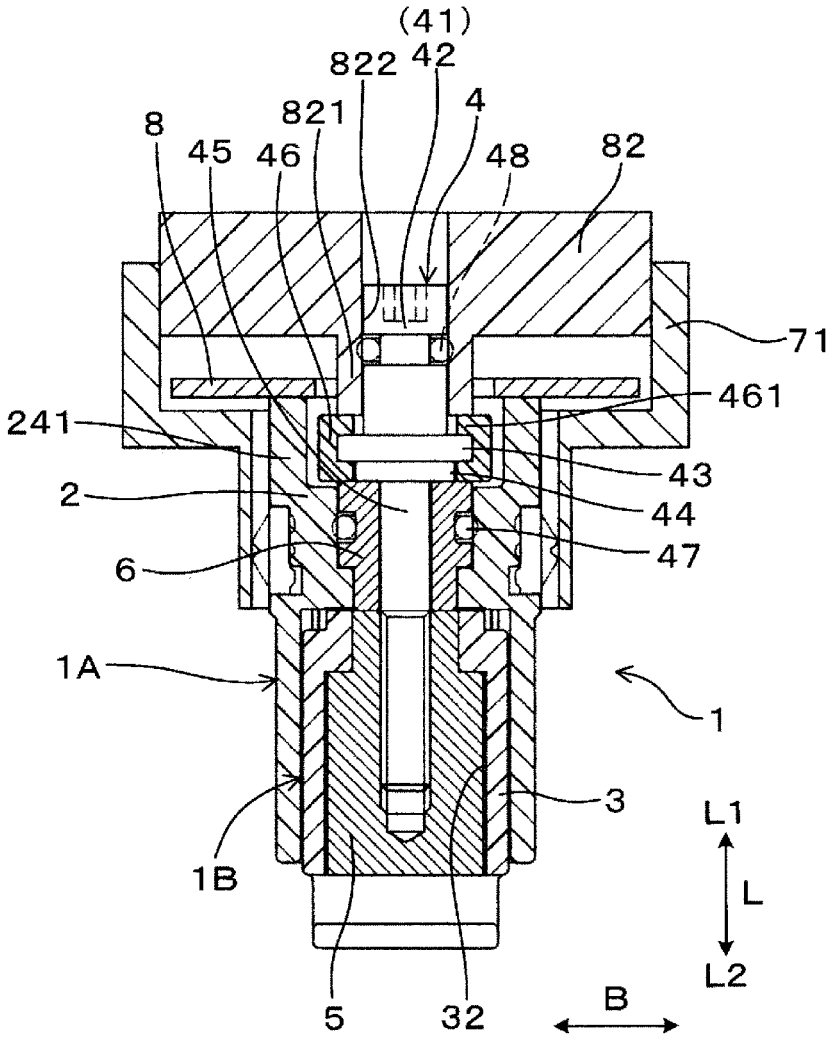
FIG. 2 is a side view in section of the connector mating body according to the first embodiment.

A preferred embodiment of the above connector mating body is described with reference to the drawings. A connector mating body 1 of a first embodiment includes a first housing 2, a second housing 3, a collar 6, a nut 5 and a bolt 4 as shown in FIGS. 1 and 2. The first housing 2 is made of resin and holds a plurality of first terminals 21. The second housing 3 is made of resin and mated with the first housing 2. The second housing 3 holds a plurality of second terminals 31, which respectively contact the first terminals 21 to be conductively connected.

Figure 3:
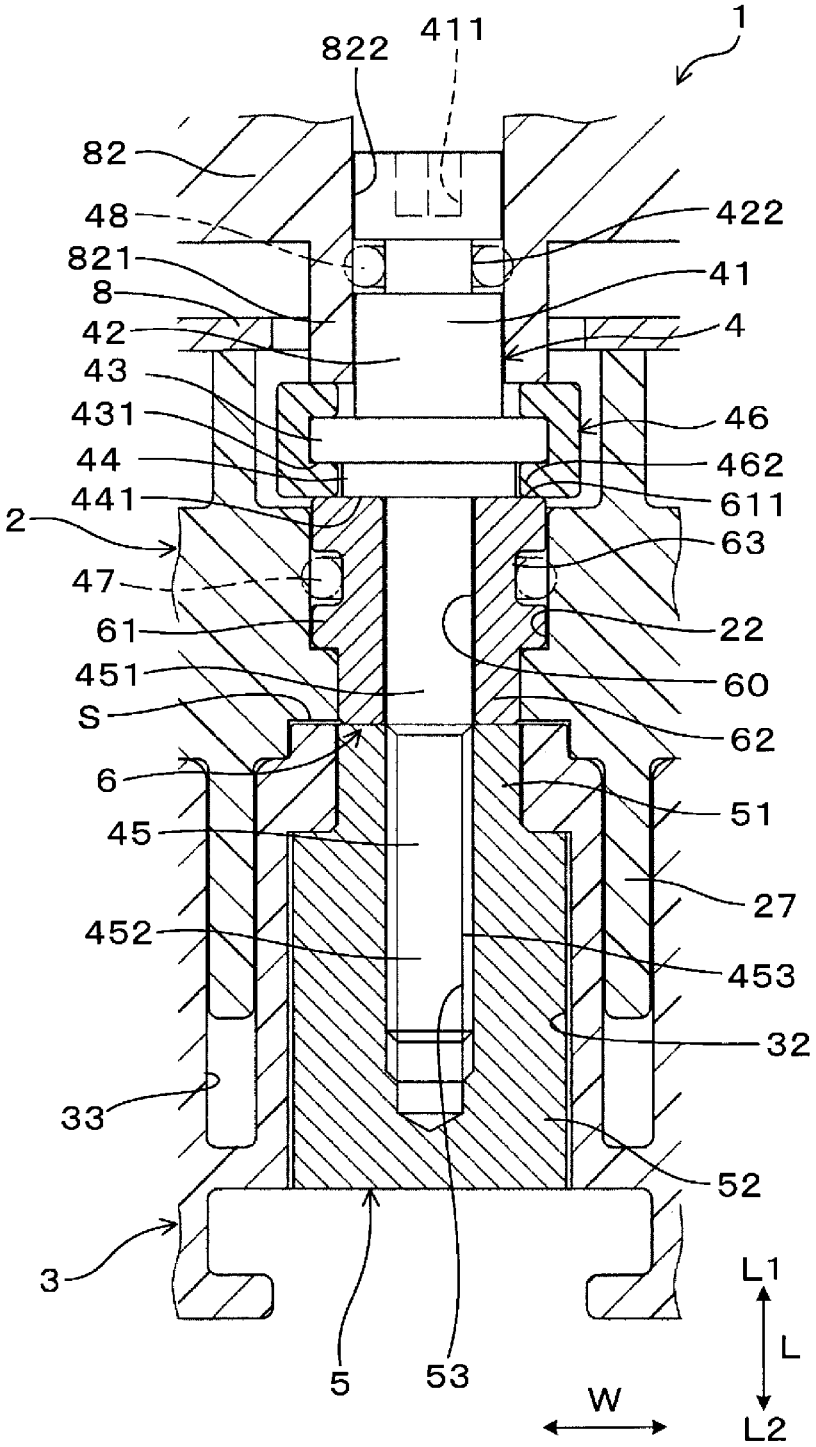
FIG. 3 is a section enlargedly showing a part of the connector mating body of FIG. 1 according to the first embodiment.

As shown in FIG. 3, the collar 6 is made of metal and arranged in a first insertion hole 22 of the first housing 2. The nut 5 is made of metal and arranged in a second insertion hole 32 of the second housing 3. The bolt 4 is made of metal and includes a head portion 41 configured to come into contact with a base end surface 611 of the collar 6 and a shaft portion 45 coaxially connected to a tip side L2 of the head portion 41, having a smaller outer diameter than the head portion 41, partially arranged on an inner peripheral side of the collar 6 and formed with an external thread 453 to be threadably engaged with an internal thread 53 of the nut 5.

A reduced-diameter portion 44 having a smaller outer diameter than a flange portion 43 serving as a maximum outer diameter portion of the head portion 41 is formed on a part of the tip side L2 of the head portion 41 of the bolt 4. Further, the flange portion 43 projects toward an outer peripheral side from the outer peripheral surface of a general portion 42 of the head portion 41 adjacent to a base end side L1 of the reduced-diameter portion 44. A tip surface 441 of the reduced-diameter portion 44 is in contact with the base end surface 611 of the collar 6. A tip part 462 of a first oil-proof sealing member 46 is sandwiched between the base end surface 611 of the collar 6 and the tip surface 431 of the flange portion 43.

The connector mating body 1 of this embodiment is described in detail below.

(Connector Mating Body 1 and Arrangement Environment Thereof)

As shown in FIG. 1, the connector mating body 1 is used as a relay connector for relaying electrical wiring when various electronic control devices 72 are electrically wired to a controller (control board) 8. The control board 8 is formed with a control circuit for controlling the various electronic control devices 72. The connector mating body 1 is formed by mating a first connector 1A composed of the plurality of first terminals 21 and the first housing 2 and a second connector 1B composed of the plurality of second terminals 31 and the second housing 3.

The electronic control devices 72 can be installed in various mechanical components 7. The mechanical component 7 of this embodiment is an automatic transmission installed in an automotive vehicle, and the electronic control devices 72 are a spool valve of a valve body, actuators such as a motor, sensors such as a resolver and the like used in the automatic transmission. The electronic control devices 72 are electrically connected to the control board 8 constituting an electronic control unit (ECU) via the plurality of first terminals 21 and the plurality of second terminals 31 of the connector mating body 1. The control board 8 is covered by a cover 82. Note that the mechanical component 7 may be one of various mechanical components other than the automatic transmission.

As shown in FIG. 1, oil (automatic transmission oil) for an automatic shift control operation, lubrication between constituent components and the like is used in the automatic transmission. The connector mating body 1 is arranged in a case hole 711 provided in a case 71 of the automatic transmission. The case 71 is engaged with the cover 82 and the control board 8 is arranged in a space surrounded by the case 71 and the cover 82.

An outer peripheral sealing member 232 for oil to be held in contact with the inner periphery of the case hole 711 is mounted on the outer periphery of the first housing 2 of the connector mating body 1. The outer peripheral sealing member 232 is arranged in an outer peripheral groove portion 231 formed in the outer periphery of the first housing 2. The leakage of the oil in the case 71 to outside of the case 71 through a clearance between the connector mating body 1 and the case hole 711 is prevented by the outer peripheral sealing member 232.

When the connector mating body 1 is arranged in the case hole 711, the plurality of second terminals 31 held in the second housing 3 are exposed to an oil environment R2 where the second terminals 31 can contact the oil. Further, the plurality of first terminals 21 held in the first housing 2 are exposed to an air environment R1 serving as a space in which the control board 8 is arranged, in other words, exposed to air.

As shown in FIGS. 1 to 10, a direction along an axial direction L of the bolt 4 is referred to as an axial direction L in the connector mating body 1 of this embodiment. Further, a direction along long sides of the connector mating body 1 in a plane perpendicular to the axial direction L is referred to as a width direction W, and a direction along short sides of the connector mating body 1 in the plane perpendicular to the axial direction L is referred to as a thickness direction B. Further, in the axial direction L of the connector mating body 1, a side where the first connector 1A is located is referred to as the base end side L1, and a side where the second connector 1B is located is referred to as the tip side L2. The base end side L1 is a side exposed to the air environment R1, and the tip side L2 is a side exposed to the oil environment R2.

Figure 4:
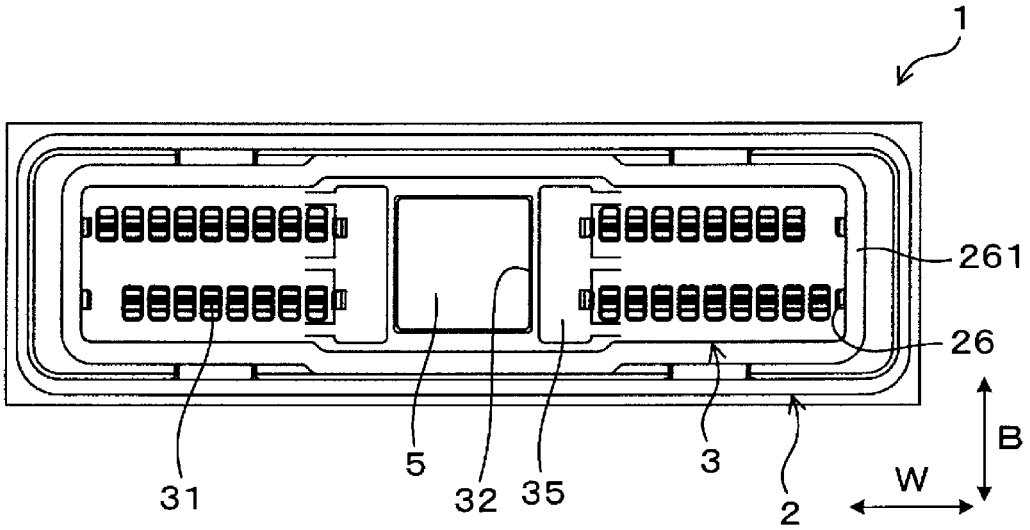
FIG. 4 is a diagram showing the connector mating body according to the first embodiment when viewed from the side of a second housing.

As shown in FIG. 4, the arrangement positions of the bolt 4, the nut 5, the collar 6 and the like and those of the first terminals 21, the second terminals 31 and the like are slightly shifted in the thickness direction B of the connector mating body 1. However, these arrangement positions are shown in the same cross-section in FIGS. 1 and 8 to 10 to facilitate graphical representation.

(Bolt 4)

As shown in FIGS. 1 to 3, the bolt 4 is arranged at a center position in the width direction W and the thickness direction B of the connector mating body 1. The bolt 4 is a special bolt whose head portion 41 has a sealing function. The bolt 4 is made of a metal material. The head portion 41 of the bolt 4 serves as a part for pressing the first housing 2 to the second housing 3 via the collar 6 when an axial force by tightening is generated.

Cross-sections of the head portion 41 and the shaft portion 45 orthogonal to the axial direction L are circular. A tool engaging portion 411 with which a tool for tightening is engaged is formed on an end part of the base end side L1 of the head portion 41. The tool engaging portion 411 of this embodiment is formed by a hexagonal recess.

Further, as shown in FIGS. 1 to 3 and 5, a groove portion 422 is formed in the outer peripheral surface of the head portion 41 of the bolt 4. A waterproof sealing member 48 for sealing a clearance between the outer peripheral surface of the head portion 41 and the inner peripheral surface of a through hole 822 of a mounting portion 821 formed on the cover 82 is mounted in the groove portion 422. The waterproof sealing member 48 is formed by an O-ring made of rubber. Besides the O-ring, the waterproof sealing member 48 may be one of various packings capable of sealing water. Even if the cover 82 of the control board 8 is wetted, the entrance of water to the control board 8 in the cover 82 through the clearance between the head portion 41 of the bolt 4 and the through hole 822 can be prevented by arranging the waterproof sealing member 48.

The general portion 42, the flange portion 43 having a larger diameter than the general portion 42 and the reduced-diameter portion 44 having a smaller diameter than the flange portion 43 are successively formed from the base end side L1 in the axial direction L on the outer peripheral surface of the head portion 41 of the bolt 4. The flange portion 43 and the reduced-diameter portion 44 are continuously formed over the entire circumference of the head portion 41 in the head portion 41 of the bolt 4. A stepped recess formed by the tip surface 431 of the flange portion 43 and the outer peripheral surface of the reduced-diameter portion 44 is formed between the flange portion 43 and the reduced-diameter portion 44. The tip part 462 of the first oil-proof sealing member 46 is arranged in the stepped recess.

Figure 5:
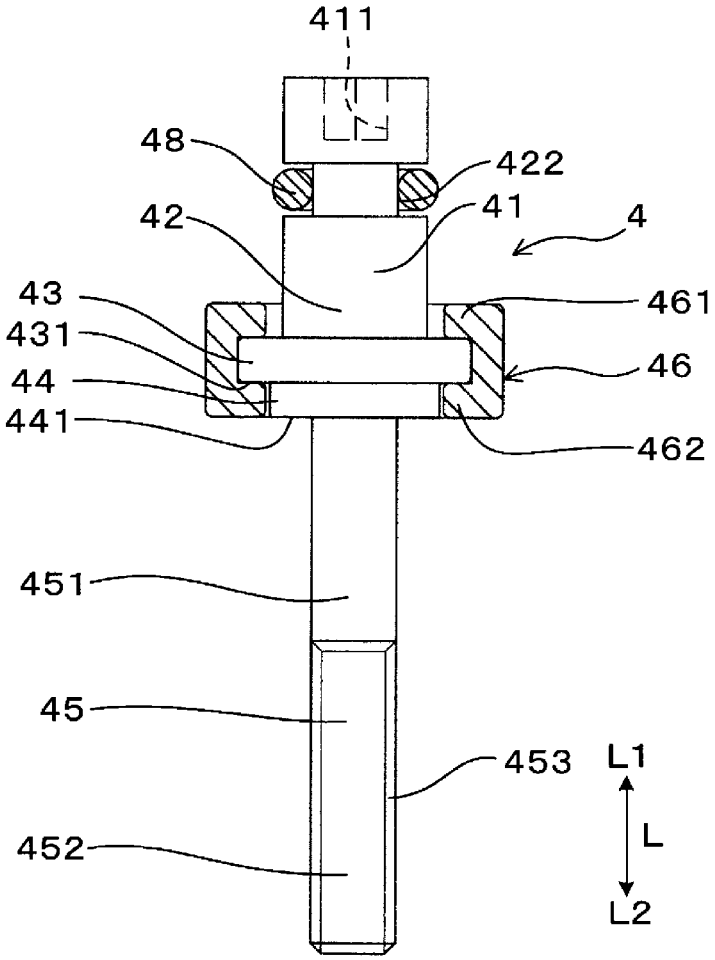
FIG. 5 is a front view showing a bolt having a sealing member mounted thereon according to the first embodiment.

As shown in FIGS. 3 and 5, the shaft portion 45 of the bolt 4 includes a base end part 451 located on the base end part L1 in the axial direction L of the shaft portion 45 and formed by a cylindrical parallel surface not formed with the external thread 453, and a tip side part 452 located on the tip side L2 in the axial direction L of the base end part 451 and formed with the external thread 453. The base end part 451 is a part to be arranged on an inner peripheral side of the collar 6, and the tip side part 452 is a part to be threadably engaged with the internal thread 53 of the nut 5.

(First Oil-Proof Sealing Member 46)

As shown in FIGS. 3 and 5, the first oil-proof sealing member 46 of this embodiment has a circular ring shape and is formed as a cap made of rubber and to be mounted on the flange portion 43 of the head portion 41 of the bolt 4 over the entire periphery. The first oil-proof sealing member 46 is continuously formed on the side of the tip surface 431 of the flange portion 43, the outer peripheral surface side of the flange portion 43 and the base end surface side of the flange portion 43. In other words, the first oil-proof sealing member 46 is shaped to cover the tip surface 431, the outer peripheral surface and the base end side of the flange portion 43. The oil penetrating into the clearance between the shaft portion 45 of the bolt 4 and the inner peripheral surface of the collar 6 through the clearance between the nut 5 and the second insertion hole 32 can be prevented from further penetrating to the control board 8 by arranging the first oil-proof sealing member 46.

As shown in FIG. 2, the base end part 461 of the first oil-proof sealing member 46 is in contact with the mounting portion 821 of the cover 82. More specifically, the base end part 461 of the first oil-proof sealing member 46 is sandwiched between the base end surface of the flange portion 43 of the head portion 41 in the bolt 4 and the tip surface of the mounting portion 821 of the cover 82.

By forming the flange portion 43 on the head portion 41 of the bolt 4, the first oil-proof sealing member 46 is easily held on the head portion 41 of the bolt 4. In manufacturing the connector mating body 1, the bolt 4 can be conveyed with the first oil-proof sealing member 46 and the waterproof sealing member 48 held thereon. In this way, transport management at the time of manufacturing the connector mating body 1 is facilitated.

(Collar 6)

Figure 6:
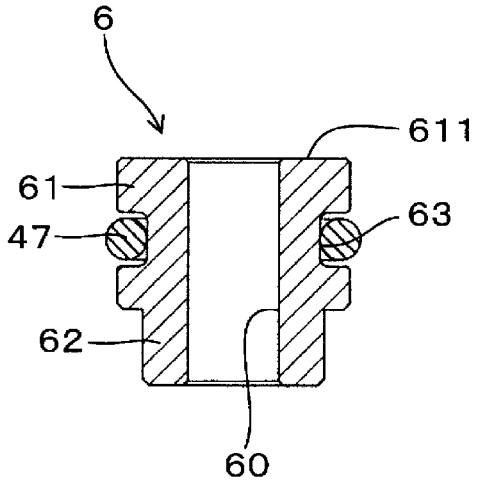
FIG. 6 is a section showing a collar according to the first embodiment.
Figure 7:
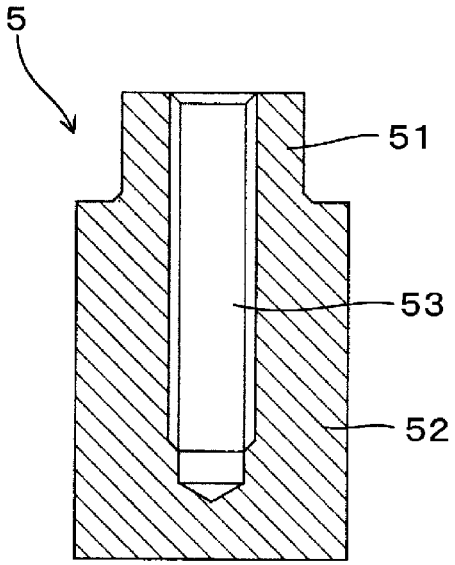
FIG. 7 is a section showing a nut according to the first embodiment.

As shown in FIGS. 1, 3 and 6, the collar 6 has a hollow cylindrical shape and is made of metal. The collar 6 is arranged in the first insertion hole 22 of the first housing 2. A center hole 60 through which the base end part 451 of the shaft portion 45 of the bolt 4 is passed is formed in a central part of the collar 6. The collar 6 is arranged at a center position in the width direction W and the thickness direction B of the first housing 2.

The collar 6 includes a large-diameter portion 61 located on the base end side L1 in the axial direction L and a small-diameter portion 62 having a smaller diameter than the large-diameter portion 61 and located on the tip side L2 in the axial direction L of the large-diameter portion 61. The first insertion hole 22 of the first housing 2 is shaped in conformity with the outer peripheral shape of the collar 6. The large-diameter portion 61 of the collar 6 serves as a part for pressing the first housing 2 to the second housing 3 when the collar 6 receives an axial force at the time of tightening the bolt 4. The collar 6 is sandwiched between the head portion 41 of the bolt 4 and the nut 5 to transmit a force by metal parts from the head portion 41 of the bolt 4 to the nut 5. Note that the collar 6 can also be arranged inside the first housing 2 by insert molding.

As shown in FIG. 3, a groove portion 63 is formed in the outer peripheral surface of the collar 6. In the collar 6 of this embodiment, the groove portion 63 is formed in the outer peripheral surface of the large-diameter portion 61 of the collar 6. A second oil-proof sealing member 47 for sealing a clearance between the outer peripheral surface of the collar 6 and the inner peripheral surface of the first insertion hole 22 of the first housing 2 is mounted in the groove portion 63. The second oil-proof sealing member 47 is formed by an O-ring made of rubber. Besides the O-ring, the second oil-proof sealing member 47 may be one of various packings capable of sealing oil. By arranging the second oil-proof sealing member 47, the oil penetrating into the clearance between the outer peripheral surface of the collar 6 and the first insertion hole 22 from a clearance between the nut 5 and the second insertion hole 32 can be prevented from further penetrating to the control board 8.

(Nut 5)

As shown in FIGS. 1 to 3 and 7, the nut 5 is formed with the internal thread (screw hole) 53 to be threadably engaged with the external thread 453 of the shaft portion 45 of the bolt 4. The nut 5 is made of a metal material. The nut 5 is arranged in the second insertion hole 32 of the second housing 3 to prevent rotation when the bolt 4 is tightened. Note that, beside a polygonal cross-sectional shape to prevent rotation with respect to the second insertion hole 32, the nut 5 can have various shapes.

The nut 5 includes a tip side nut portion 52 located on the tip side L2 in the axial direction L and a base end side nut portion 51 located on the base end side L1 in the axial direction L of the tip side nut portion 52. The tip side nut portion 51 is formed to have a rectangular cross-section orthogonal to the axial direction L, and the base end side nut portion 51 is formed to have a circular cross-section orthogonal to the axial direction L. An outer cross-sectional shape of the tip side nut portion 52 orthogonal to the axial direction L is larger than that of the base end side nut portion 51 orthogonal to the axial direction L. The tip side nut portion 52 serves as a part for pressing the second housing 3 toward the first housing 2 when receiving an axial force by the tightening of the bolt 4. The inner peripheral surface of the second insertion hole 32 of the second housing 3 is formed to have a cross-sectional shape in conformity with the cross-sectional shapes of the tip side nut portion 52 and the base end side nut portion 51.

The nut 5 is arranged in the second insertion hole 32 of the second housing 3 after the second housing 3 is molded. The nut 5 may be arranged in the second housing 3 by insert-molding the second housing 3. In the connector mating body 1, the first insertion hole 22 of the first housing 2 and the second insertion hole 32 of the second housing 3 communicate, and the external thread 453 of the shaft portion 41 of the bolt 4 is fastened to the internal thread 53 of the nut 5 via the collar 6.

(First Terminals 21)

Figure 8:
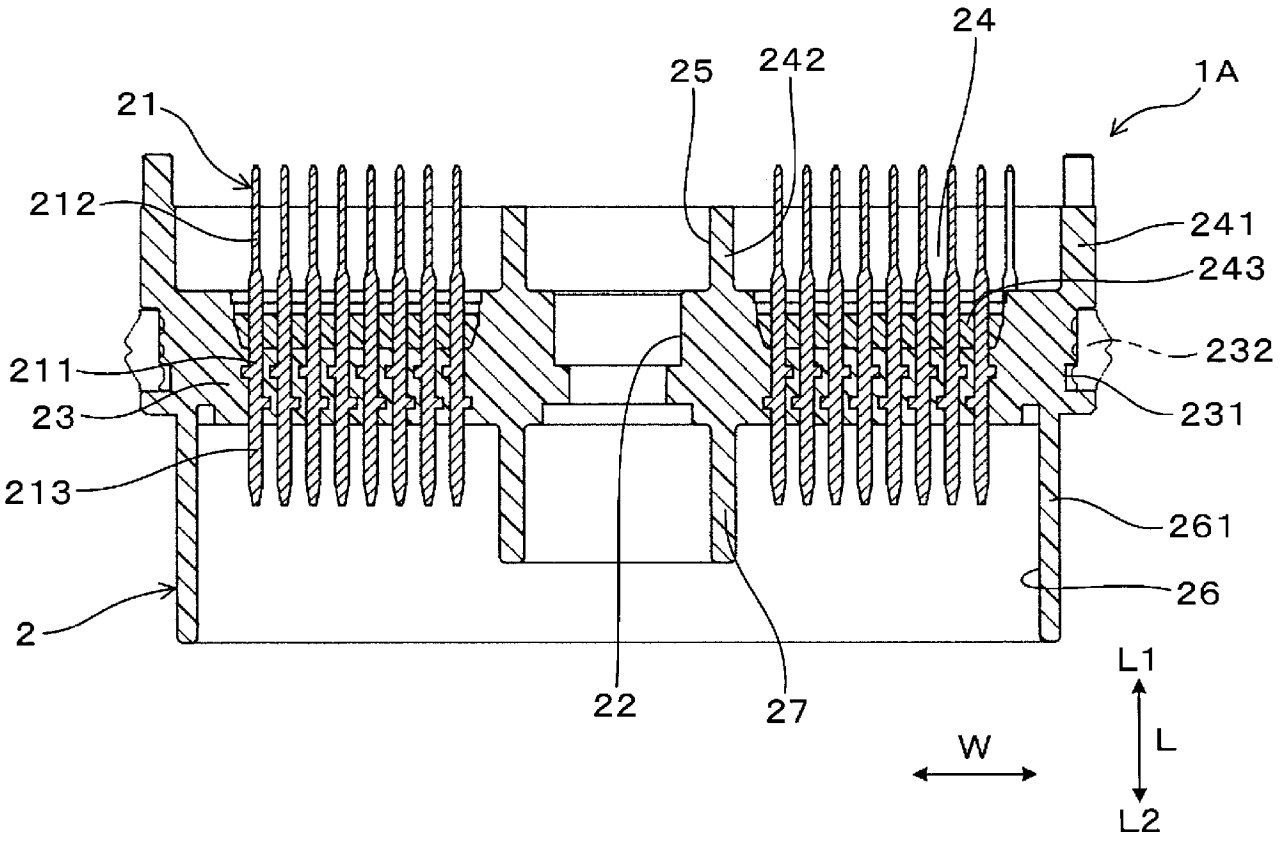
FIG. 8 is a front view in section of a first connector of the connector mating body according to the first embodiment.

As shown in FIGS. 1 and 8, the connector mating body 1 of this embodiment is mounted on a printed board serving as the control board 8. The plurality of first terminals 21 are conductor pins serving as male terminals to be conductively connected to conductive parts provided on the control board 8. The first terminals 21 are made of a conductive material. The first terminals 21 are inserted into through holes 81 formed in the control board 8 in the air environment R1 and electrically connected to the conductive parts of the control board 8 by soldering or the like.

Intermediate parts 211 in the axial direction L of the plurality of first terminals 21 are embedded in a facing surface portion 23 of the first housing 2 facing the second housing 3. Both end parts 212, 213 of the plurality of first terminals 21 project toward both sides in the axial direction L from the facing surface portion 23. The base end parts 212 located on the base end side L1 of the plurality of first terminals 21 are connected to the control board 8. The tip parts 213 located on the tip side L2 of the respective first terminals 21 in the first housing 2 are connected to the respective second terminals 31 in the second housing 3.

The plurality of first terminals 21 are arranged side by side in the width direction W and the thickness direction B orthogonal to the axial direction L while being parallel to the axial direction L of the bolt 4 in the first housing 2. The plurality of first terminals 21 are arranged on both sides in the width direction W of the first insertion hole 22 in a divided manner.

(Second Terminals 31)

Figure 9:
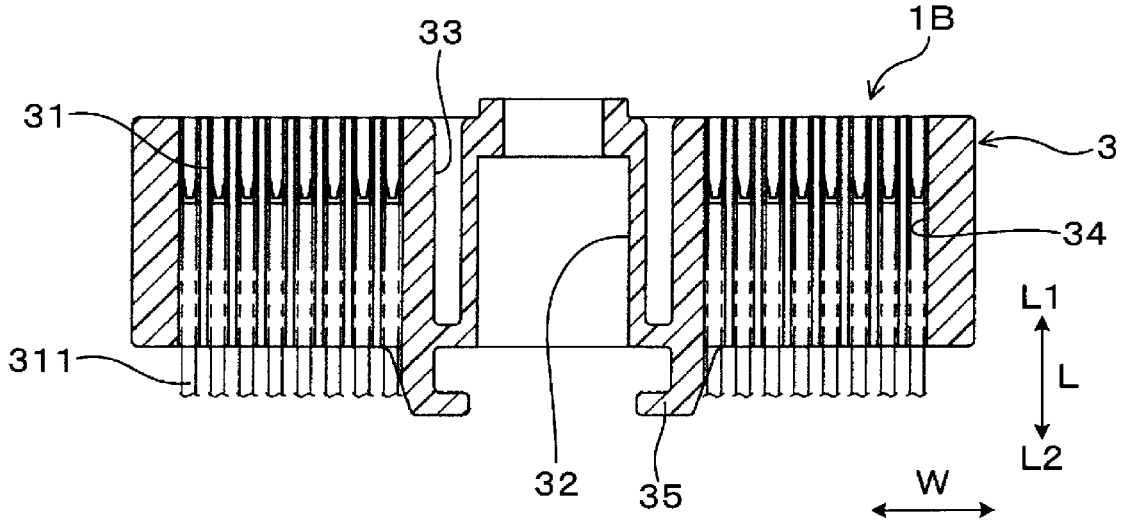
FIG. 9 is a front view in section of a second connector of the connector mating body according to the first embodiment.

As shown in FIGS. 1, 4 and 9, the plurality of second terminals 31 are arranged in the oil environment R2 and wires 311 to be wired to the electronic control devices 72 are respectively connected to the second terminals 31. The second terminals 31 are made of a conductive material. The plurality of second terminals 31 constitute female terminals and are held in terminal holes 34 formed in the second housing 3.

The plurality of second terminals 31 are arranged side by side in the width direction W and the thickness direction B orthogonal to the axial direction L while being parallel to the axial direction L of the bolt 4 in the first housing 2. The plurality of second terminals 31 are arranged on both sides in the width direction W of the second insertion hole 32 in a divided manner.

(First Housing 2)

As shown in FIG. 8, the first housing 2 forms the first connector 1A serving as a male connector, and is formed by insert-molding using a resin material such as thermoplastic resin with the plurality of first terminals 21 inserted. The first housing 2 includes the facing surface portion 23 which faces the second housing 3, arrangement recesses 24 which are formed on the base end side L1 of the facing surface portion 23 and in which the base end parts 212 of the plurality of first terminals 21 are arranged, a head portion recess 25 which is formed on the base end side L1 of the facing surface portion 23 and in which the head portion 41 of the bolt 4 is arranged, and fitting recesses 26 which are formed on the tip side L2 of the facing surface portion 23 and in which the second connector 1B (second housing 3) is fit. The first insertion hole 22 is formed to penetrate through the facing surface portion 23 in the axial direction L at a center position of the first housing 2 in the width direction W and the thickness direction B.

As shown in FIGS. 2 and 8, the arrangement recesses 24 are formed on both sides in the width direction W of the head portion recess 25. The arrangement recesses 24 are formed by being surrounded by an outer wall portion 241 projecting toward the base end side L1 from an outer peripheral part of the facing surface portion 23 and partition wall portions 242 formed in the outer wall portion 241. The partition wall portions 242 are formed on both sides in the width direction W of the head portion 41 of the bolt 4, and the head portion recess 25 is formed between a pair of the partition wall portions 242.

A sealing resin portion 243 made of adhesive such as thermosetting resin is formed in a bottom part of the arrangement recess 24. The sealing resin portion 243 is formed to be in contact with the entire periphery of each first terminal 21. Even if the oil penetrates into a clearance between each first terminal 21 and the first housing 2, this oil can be prevented from penetrating to the control board 8 along each first terminal 21 by the sealing resin portion 243.

The fitting recesses 26 are formed on both sides in the width direction W of the first insertion hole 22 in a divided manner. The fitting recesses 26 are formed by being surrounded by a side wall portion 261 projecting toward the tip side L2 from the outer peripheral part of the facing surface portion 23. Further, ribs 27 to be inserted into the second housing 3 are formed inside the side wall portion 261 and on both sides in the width direction W of the collar 6.

(Second Housing 3)

As shown in FIGS. 3 and 9, the second housing 3 forms the second connector 1B serving as a female connector and is formed by molding a resin material such as thermoplastic resin. The second housing 3 is formed with insertion recesses 33 into which the ribs 27 of the first housing 2 are inserted. The insertion recesses 33 are formed in conformity with the entire or partial shapes of the ribs 27 to guide the ribs 27 in the axial direction L.

Further, as shown in FIG. 1, a bracket 36 for loosely movably mounting the connector mating body 1 on the automatic transmission serving as the mechanical component 7 is mounted on the second housing 3. The second housing 3 is formed with an engaging portion 35 to be loosely movably engaged with the bracket 36. The connector mating body 1 is loosely movably supported on the automatic transmission by the bracket 36. The connector mating body 1 loosely moves with respect to the automatic transmission in mounting the case 71 on the automatic transmission, whereby the connector mating body 1 is easily arranged in the case hole 711 of the case 71.

As shown in FIG. 1, in the connector mating body 1, the facing surface portion 23 of the first housing 2 and the second housing 3 are facing each other in the fitting recesses 26 in which the plurality of first terminals 21 and the plurality of second terminals 321 are in contact. On the other hand, as shown in FIG. 3, a clearance S is formed between a part of the second housing 2 and a part of the second housing 3 arranged in a part where the large-diameter portion 61 of the collar 6 and the tip side nut portion 52 of the nut 5 are facing each other in the axial direction L. By forming this clearance S, it is prevented that a load is excessively applied to the parts of the first and second housings 2, 3 sandwiched by the large-diameter portion 61 of the collar 6 and the tip side nut portion 52 of the nut 5.

(Assembly/Arrangement Method of Connector Mating Body 1)

Figure 10:
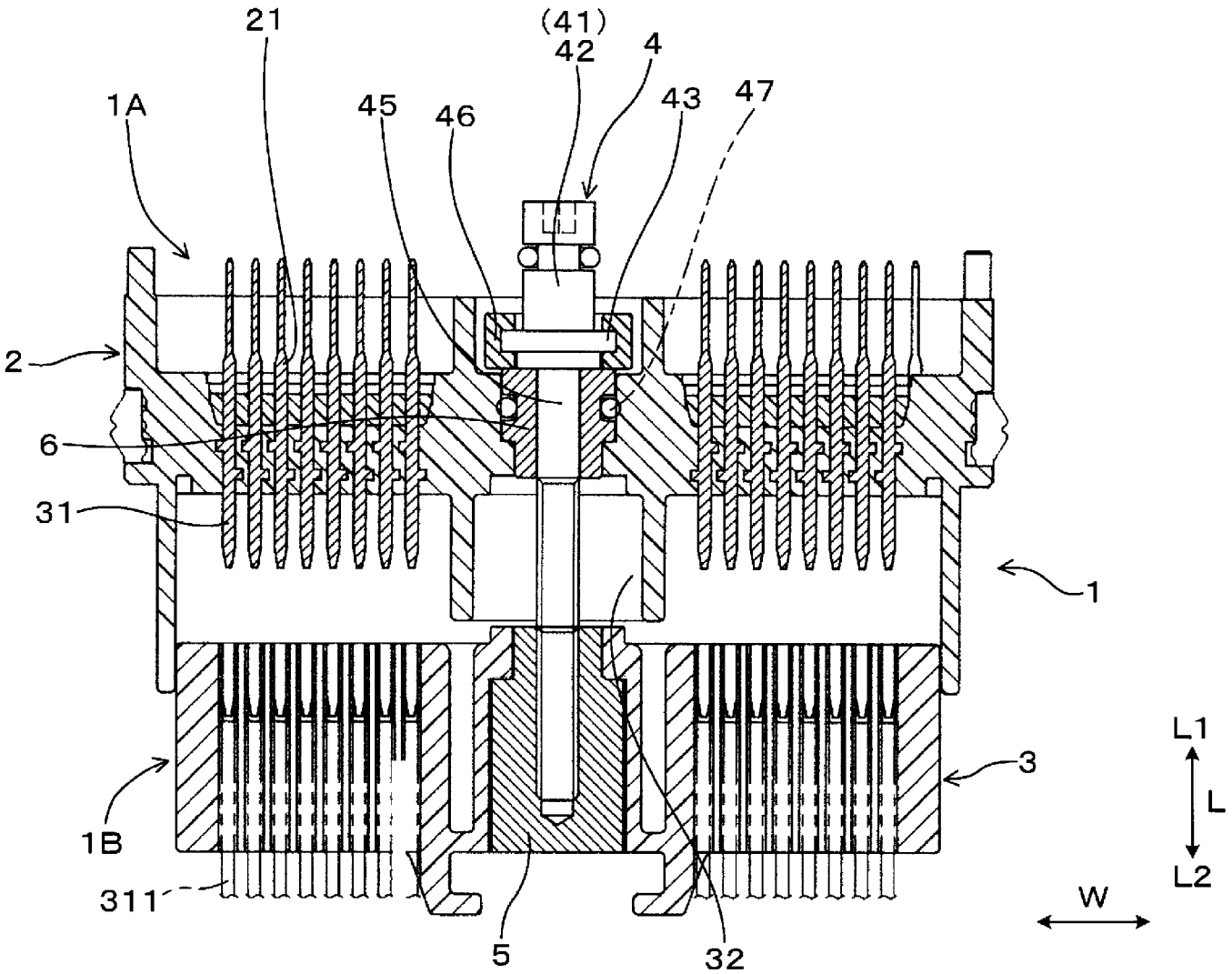
FIG. 10 is a front view in section showing a state where the first and second connectors are mated to form the connector mating body according to the first embodiment.

Next, a case where the connector mating body 1 is used as a relay connector is described. In assembling the connector mating body 1, the first connector 1A in which the plurality of first terminals 21 are provided in the first housing 2, the second connector 1B in which the plurality of second terminals 31 are provided in the second housing 3, the bolt 4 having the first oil-proof sealing member 46 and the waterproof sealing member 48 mounted thereon, the collar 6 having the second oil-proof sealing member 47 mounted thereon and the nut 5 are prepared as shown in FIGS. 5 to 9. Further, the wires 311 are connected to the respective second terminals 31 of the second connector 1B. Then, as shown in FIG. 10, the collar 6 is arranged in the first insertion hole 22 of the first housing 2 and the nut 5 is arranged in the second insertion hole 32 of the second connector 1B. Further, the shaft portion 45 of the bolt 4 is arranged in the center hole 60 of the collar 6 in the first housing 2.

Subsequently, as shown in FIG. 10, the first and second connectors 1A, 1B are caused to face each other with the plurality of first terminals 21 and the plurality of second terminals 31 facing each other. Then, the bolt 4 is rotated by the tool engaged with the tool engaging portion 411 of the head portion 41 to threadably engage the external thread 453 of the shaft portion 45 of the bolt 4 with the internal thread 53 of the nut 5. At this time, as the bolt 4 is rotated, the head portion 41 of the bolt 4 pushes the first housing 2 toward the second housing 3 via the collar 6.

Subsequently, the first connector 1A is brought closer to the second connector 1B and the respective first terminals 21 are inserted into the respective second terminals 31 by the large-diameter portion 61 of the collar 6 pushed by the bolt 4 and the tip side nut portion 52 of the nut 5. As the bolt 4 is tightened with the nuts, the tip parts 213 of the respective first terminals 21 are connected to the respective second terminals 31. In this way, the connector mating body 1 in which the first and second connectors 1A, 1B are mated is formed.

Subsequently, as shown in FIG. 1, the connector mating body 1 is mounted on the automatic transmission serving as the mechanical component 7 by the bracket 36 mounted on the engaging portion 35 of the second connector 1B. In mounting the case 71 on the automatic transmission, the connector mating body 1 is made loosely movable with respect to the automatic transmission by the bracket 36, and the connector mating body 1 is easily arranged in the case hole 711 of the case 71.

Subsequently, the control board 8 is arranged in the first connector 1A of the connector mating body 1. At this time, the base end parts 212 of the respective first terminals 21 projecting toward the base end side L1 from the first connector 1A are inserted into the through holes 81 of the control board 8. Then, the base end parts 212 of the respective first terminals 21 are joined to the conductive parts of the control board 8 by soldering or the like. Thereafter, the control board 8 is covered by the cover 82.

Functions and Effects

In the connector mating body 1 of this embodiment, the first and second housings 2, 3 are prevented from being compressed more than necessary by sandwiching the collar 6 made of metal between the head portion 41 of the bolt 4 and the nut 5. Further, the first oil-proof sealing member 46 can be protected from damage by devising the shape of the head portion 41 of the bolt 4 and the arrangement position of the first oil-proof sealing member 46.

Specifically, the collar 6 sandwiched between the head portion 41 of the bolt 4 and the nut 5 is arranged on the outer periphery of the shaft portion 45 of the bolt 4, and the reduced-diameter portion 44 is formed on the outer periphery of the head portion 41 of the bolt 4. The first oil-proof sealing member 46 is sandwiched between the base end surface 611 of the collar 6 and the tip surface 431 of the flange portion 43 adjacent to the reduced-diameter portion 44. In this way, the first oil-proof sealing member 46 is not arranged on the outer peripheral surface of the shaft portion 45 in the bolt 4 to be arranged in the collar 6, and the first oil-proof sealing member 46 does not slide on the inner peripheral surface of the collar 6 when the bolt 4 is tightened or loosened. Therefore, the first oil-proof sealing member 46 can be prevented from damage when the bolt 4 is tightened and loosened.

When the tip surface 441 of the reduced-diameter portion 44 of the bolt 4 comes into contact with the base end surface 611 of the collar 6 and the first oil-proof sealing member 46 is sandwiched between the tip surface 431 of the flange portion 43 of the head portion 41 in the bolt 4 and the base end surface 611 of the collar 6, the clearance between the bolt 4 and the collar 6 can be sealed by the first oil-proof sealing member 46. Further, when the bolt 4 is tightened with the nut 5, a positional relationship of the first and second housings 2, 3 is fixed by coupling metal members, i.e. the bolt 4, the collar 6 and the nut 5, to each other. Thus, the first and second housings 2, 3 are not compressed more than necessary and a mated state of the first and second housings 2, 3 is properly maintained.

Therefore, according to the connector mating body 1 of this embodiment, the sealing member can be prevented from damage when the bolt 4 is tightened and loosened.

Figure 11:
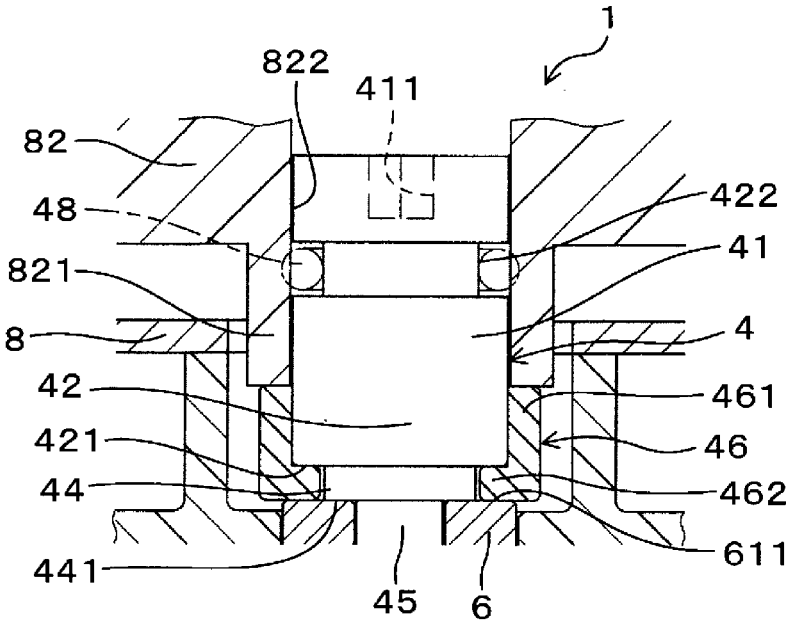
FIG. 11 is a front view in section enlargedly showing a part of another connector mating body according to the first embodiment.

Note that if the flange portion 43 is not formed on the outer periphery of the head portion 41 of the bolt 4 as shown in FIG. 11, the first oil-proof sealing member 46 can be sandwiched between the base end surface 611 of the collar 6 and the tip surface 421 of the general portion 42 adjacent to the base end side L1 of the reduced-diameter portion 44. In this case, the first oil-proof sealing member 46 is continuously formed from the outer peripheral surface side of the reduced-diameter portion 44 to the outer peripheral surface side of the general portion 42.

Second Embodiment

Figure 12:
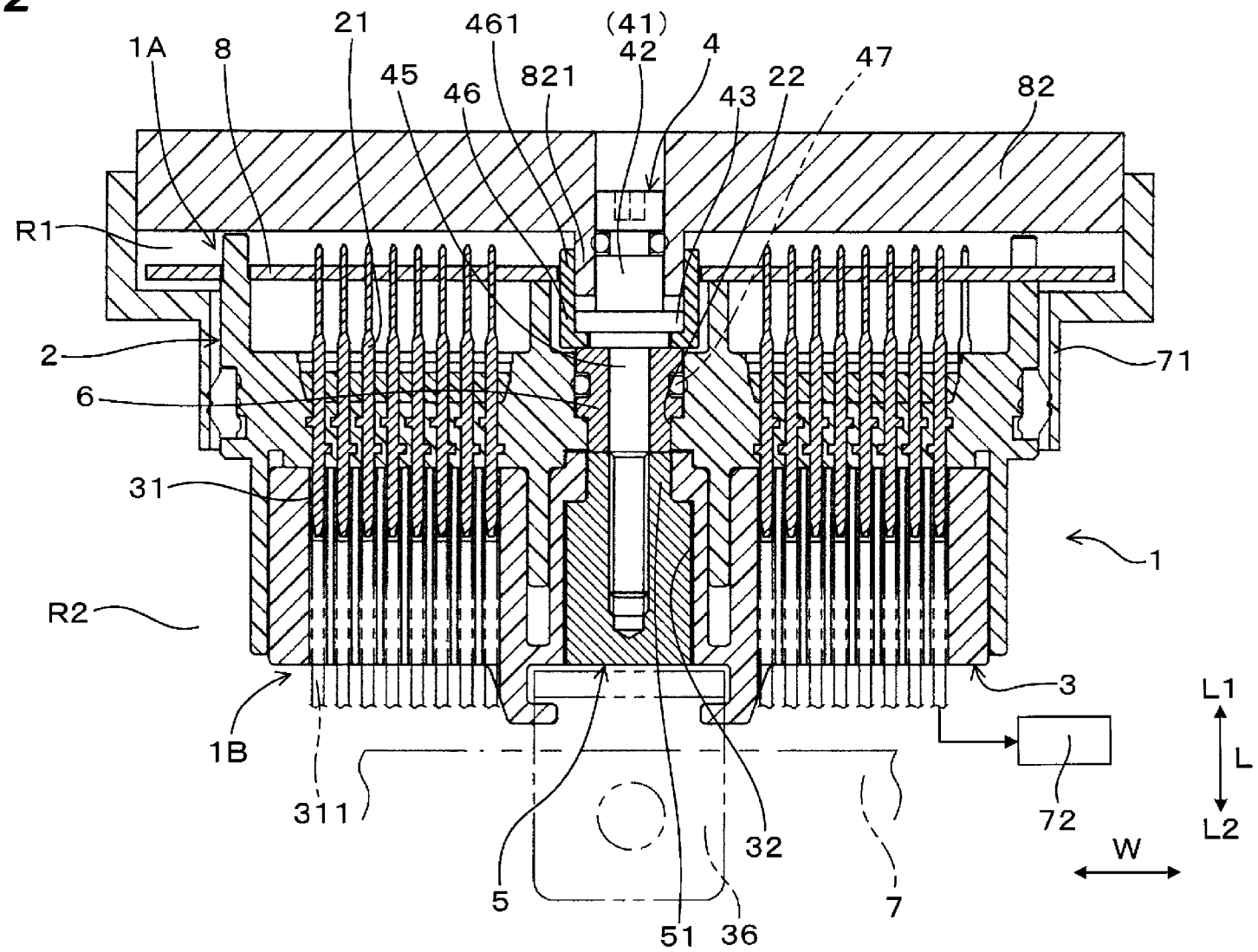
FIG. 12 is a front view in section of a connector mating body according to a second embodiment.

As shown in FIG. 12, a first oil-proof sealing member 46 of a second embodiment is continuously formed from the side of a tip surface 431 of a flange portion 43 to an outer peripheral surface side of the flange portion 43. Further, a base end part 461 of the first oil-proof sealing member 46 of this embodiment is mounted on the outer peripheral surface of a mounting portion 821 of a cover 82. The other configuration of a connector mating body 1 of this embodiment is similar to those of the first embodiment.

In the connector mating body 1 of this embodiment, the first oil-proof sealing member 46 is mounted on the outer peripheral surface of the mounting portion 821 of the cover 82, whereby the cover 82 engaged with a case 71 and the head portion 41 of the bolt 4 can be held on the case 71 with an enhanced force. Other functions, effects and the like of the connector mating body 1 of this embodiment are similar to those of the first embodiment. Further, also in this embodiment, constituent elements denoted by the same reference signs as those shown in the first embodiment are similar to those of the first embodiment.

The connector mating body 1 of the present disclosure is not limited only to the respective embodiments and different embodiments can be carried out without departing from the gist of the present disclosure. Further, the present disclosure includes various modifications and modifications and the like within the scope of equivalents. Furthermore, combinations, forms and the like of various constituent elements envisaged from the present disclosure are also included in the technical concept of the present invention.

What is claimed is:

1. A connector mating body, comprising:

a first housing holding a plurality of first terminals;

a second housing holding a plurality of second terminals to be respectively conductively connected to the first terminals, the second housing being mated with the first housing;

a collar made of metal and arranged in a first insertion hole of the first housing;

a nut made of metal and arranged in a second insertion hole of the second housing; and a bolt made of metal and including a head portion configured to come into contact with a base end surface of the collar and a shaft portion coaxially connected to a tip side of the head portion, having a smaller outer diameter than the head portion, partially arranged on an inner peripheral side of the collar and formed with an external thread to be threadably engaged with an internal thread of the nut, wherein:

a reduced-diameter portion having a smaller outer diameter than a maximum outer diameter portion of the head portion is formed on a tip side part of the head portion, a tip surface of the reduced-diameter portion is in contact with a base end surface of the collar, and a sealing member is sandwiched between the base end surface of the collar and a tip surface of the maximum outer diameter portion adjacent to the reduced-diameter portion.

2. The connector mating body of claim 1, wherein:

the maximum outer diameter portion is formed as a flange portion projecting toward an outer peripheral side from an outer peripheral surface of a general portion of the head portion, and the sealing member is sandwiched between the base end surface of the collar and a tip surface of the flange portion.

3. The connector mating body of claim 2, wherein the sealing member is continuously formed from a tip surface side of the flange portion to an outer peripheral surface side of the flange portion.

4. The connector mating body of claim 2, wherein the sealing member is continuously formed on a tip surface side of the flange portion, an outer peripheral surface side of the flange portion and a base end surface side of the flange portion.

5. The connector mating body of claim 1, wherein:

the plurality of first terminals are conductor pins to be conductively connected to conductive parts provided on a control board, the control board is covered by a cover formed with a mounting portion to be mounted on an outer peripheral surface of a general portion of the head portion, and a base end part of the sealing member is in contact with the mounting portion.

6. The connector mating body of claim 5, the base end part of the sealing member is mounted on an outer peripheral surface of the mounting portion.

7. The connector mating body of claim 5, wherein the plurality of first terminals are exposed to an air environment in which the control board is arranged, the plurality of second terminals are exposed to an oil environment, and a sealing member for sealing a clearance between the outer peripheral surface of the general portion and an inner peripheral surface of the mounting portion is mounted on the outer peripheral surface of the general portion of the head portion.

* * * * *